US006097261A

United States Patent [19]

Wendel

[11] Patent Number: 6,097,261

[45] Date of Patent: Aug. 1, 2000

[54] NONRECIPROCAL MICROWAVE COMPONENT HAVING ADJUSTABLE MAGNETIC FIELD STRENGTH

[75] Inventor: Ralf Wendel, Pinneberg, Germany

[73] Assignee: U.S. Philips Corporation, New York, N.Y.

[21] Appl. No.: 09/129,859

[22] Filed: Aug. 6, 1998

[30] Foreign Application Priority Data

Aug. 7, 1997 [DE] Germany ..... 197 34 098

[51] Int. Cl.[7] ..... H01P 1/383

[52] U.S. Cl. ..... 333/1.1; 333/24.2

[58] Field of Search ..... 333/1.1, 24.1, 333/24.2

[56] References Cited

U.S. PATENT DOCUMENTS 3,935,549 1/1976 Jachowski ..... 333/1.1

FOREIGN PATENT DOCUMENTS 1252838 8/1986 Russian Federation ..... 333/1.1

OTHER PUBLICATIONS

PHD 97,020, U.S. application No. 09/026,450, filed: Feb. 19, 1998.

*Primary Examiner*—Paul Gensler
*Attorney, Agent, or Firm*—Daniel J. Piotrowski

[57] ABSTRACT

A microwave component is described with a microwave guiding arrangement for conducting electromagnetic waves and with a gyromagnetic material which is arranged in operational connection with the electromagnetic waves and which can be energized by a magnetic field of adjustable field strength in that the gyromagnetic material, at least one magnet for generating the magnetic field, and a geometrically changeable magnetic tuning element are arranged in a magnetic circuit, said tuning element having a changeable magnetic permeance for the purpose of tuning the magnetic field strength. It is achieved in this microwave component that the tuning element is so designed that its operability is safeguarded also for different ways of incorporation of the microwave component in that the magnetic tuning element comprises a magnetically permeable strip which is arranged with sliding possibility, and the geometric shape of a spatial region forming part of the magnetic circuit and having a magnetic permeance value lower than that of the strip is changed by the displacement of this strip.

5 Claims, 10 Drawing Sheets

NONRECIPROCAL MICROWAVE COMPONENT HAVING ADJUSTABLE MAGNETIC FIELD STRENGTH

BACKGROUND OF THE INVENTION

The invention relates to a microwave component with a microwave guiding arrangement for conducting electromagnetic waves and a ferromagnetic material which is arranged in operational connection with the electromagnetic waves and is capable of being energized by means of a magnetic field of a given field strength. The ferromagnetic material, at least one magnet for generating the magnetic field, and a geometrically changeable magnetic tuning element are arranged in a magnetic circuit, the tuning element having a changeable magnetic permeance for the purpose of adjusting the magnetic field strength.

In the microwave component in accordance with DE 197 07 153, the geometrically changeable magnetic tuning element is preferably formed by an adjustable screw, an adjustable pin, or a mechanically deformable strip, by means of which the width of an air gap can be changed, which leads to a changeable magnetic permeance. A magnetic tuning element thus constructed simplifies the tuning of the magnetic field strength.

It is found, however, that drawbacks can arise in the handling of magnetic tuning elements when the microwave guiding arrangement is not arranged adjacent the bottom portion or bottom region of the housing, as shown in reference patent DE 197 07 153, but in a different location, and when as a result of this an arrangement of the magnetic tuning element adjacent the bottom portion would represent the constructionally most favorable solution. That portion of the housing is referred to as bottom portion here which is brought into an at least locally mating contact with parts of an appliance or the like provided for accommodating the microwave component when the latter is incorporated into the appliance. The accessibility of this bottom portion may be limited after the incorporation of the microwave component to such an extent that a tuning of the magnetic circuit of the microwave component is unacceptably hampered.

SUMMARY OF THE INVENTION

The invention has for its object to construct the magnetic tuning element such that a convenient handling thereof is safeguarded also for different assembly positions of the microwave component.

According to the invention, this object is achieved in that the magnetic tuning element comprises a magnetically permeable strip which is arranged with sliding possibility, and in that the geometric shape of a spatial region which forms part of the magnetic circuit and whose magnetic permeance is smaller than that of the strip is changed by a sliding movement of the strip.

The constructional element referred to as "strip" will generally be a component formed from a magnetically permeable material which is arranged with sliding possibility in a spatial region, which forms part of the magnetic circuit, and which has a low magnetic permeance value. This constructional element, i.e. this strip, may preferably be a piece of magnetically permeable metal plating which is movably arranged in an air gap such that the shape, in particular the width of this air gap is changed when the strip is shifted. A very exact tuning of the magnetic field strength can thus be achieved by means of an easily controllable and finely adjustable operation. A strip, moreover, is constructionally simpler than, for example, an adjustment screw and can be tuned more finely than, for example, a strip which is to be bent.

Preferably, a housing at least partly surrounds the microwave guiding arrangement, the ferromagnetic material, and the magnet. The housing is formed at least locally from a magnetically permeable material and is arranged in the magnetic circuit, and forms at least part of the magnetic tuning element with at least one of its regions arranged in the magnetic circuit, and the strip is mounted to it with sliding possibility. The magnetic tuning element may in particular be arranged adjacent a bottom portion of the housing, where a retaining connection between the microwave component and a holder element provided for this purpose is achieved upon the incorporation in an appliance or the like. This bottom portion of the housing thus provides a mechanical and thermal connection to the appliance in which the microwave component is utilized. A strip lying with sliding possibility against this bottom portion can still be adjusted in a simple and accurate manner also when the bottom portion itself is no longer accessible along its planar dimension on account of the building-in arrangement described.

The construction of the magnetic tuning element according to the invention is advantageously adapted for use in a microwave component in which the microwave guiding arrangement is positioned at a certain spatial distance from the bottom portion of the housing. Such a positioning of the microwave guiding arrangement is advantageously chosen when the microwave component comprises besides the microwave guiding arrangement also further constructional elements whose arrangement immediately adjacent the bottom portion of the housing is preferable or necessary. This may relate in particular to thermally loaded constructional elements such as, for example, load impedances. A heat removal from such load impedances is safeguarded only in the case of an optimized thermal contact with the surroundings of the microwave component, and thus preferably with the bottom portion of the housing.

BRIEF DESCRIPTION OF THE DRAWINGS

Embodiments of the invention are shown in the drawing and are explained in more detail below. Corresponding components have been given the same reference numerals throughout the drawings, in which.

DETAILED DESCRIPTION OF THE PREFERRED EMBODIMENTS

Figure 1:
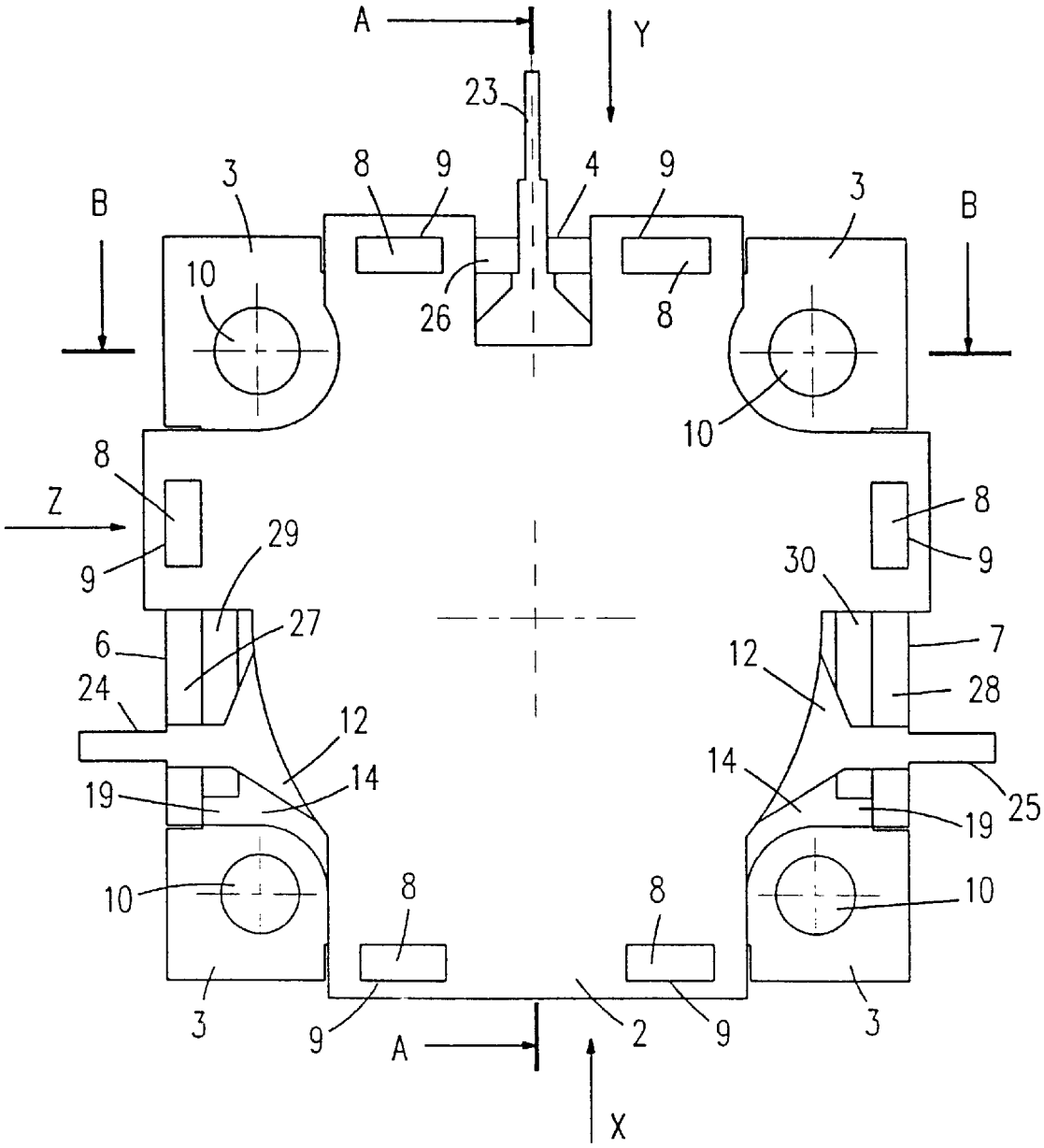
FIG. 1 is a plan view of a microwave component in a first as well as in a second embodiment.
Figure 2:
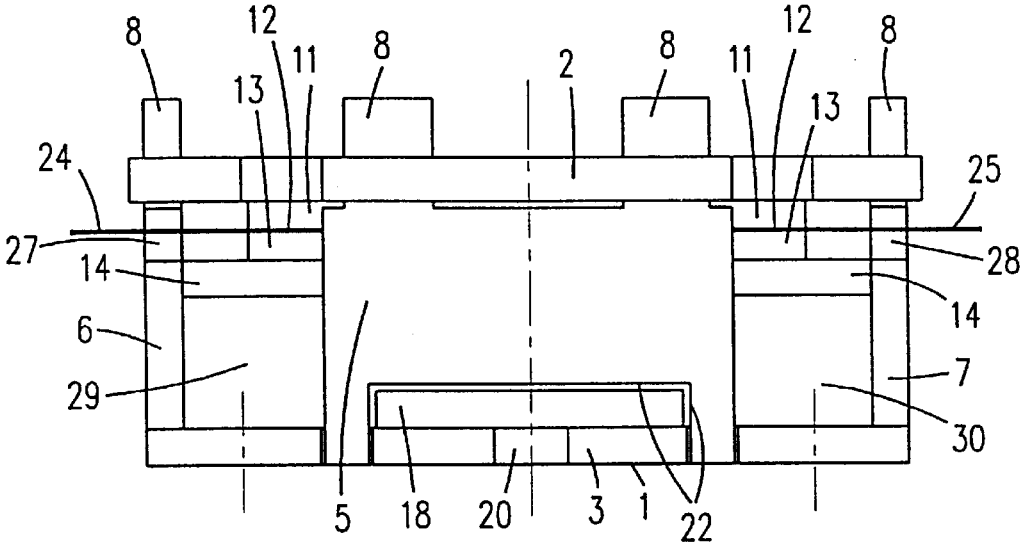
FIG. 2 is a rear elevation of the microwave component of FIG. 1, referred to as view X hereinafter.
Figure 3:
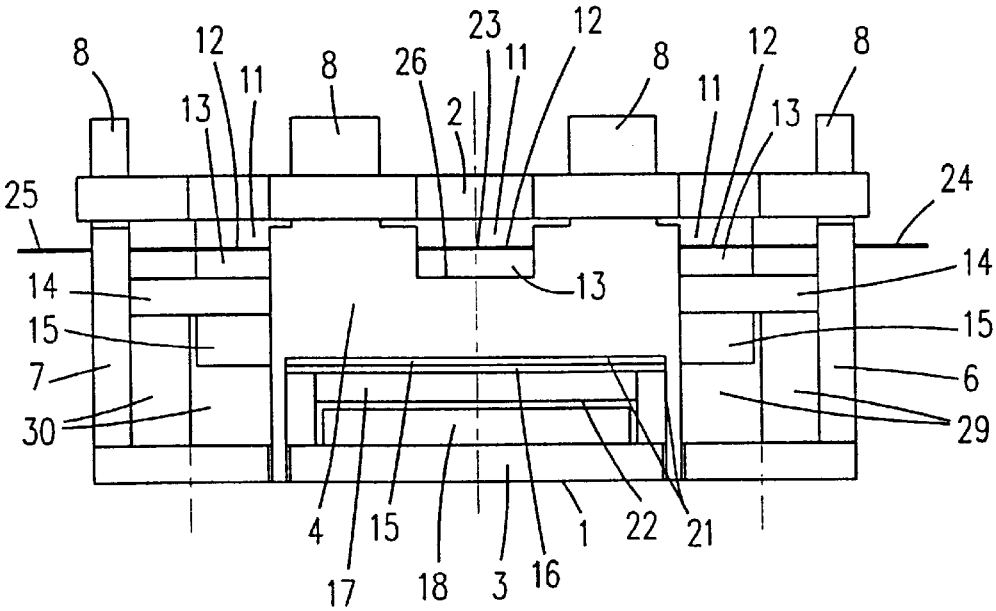
FIG. 3 is a front elevation of the first embodiment of the microwave component of FIG. 1, referred to as view Y hereinafter.
Figure 4:
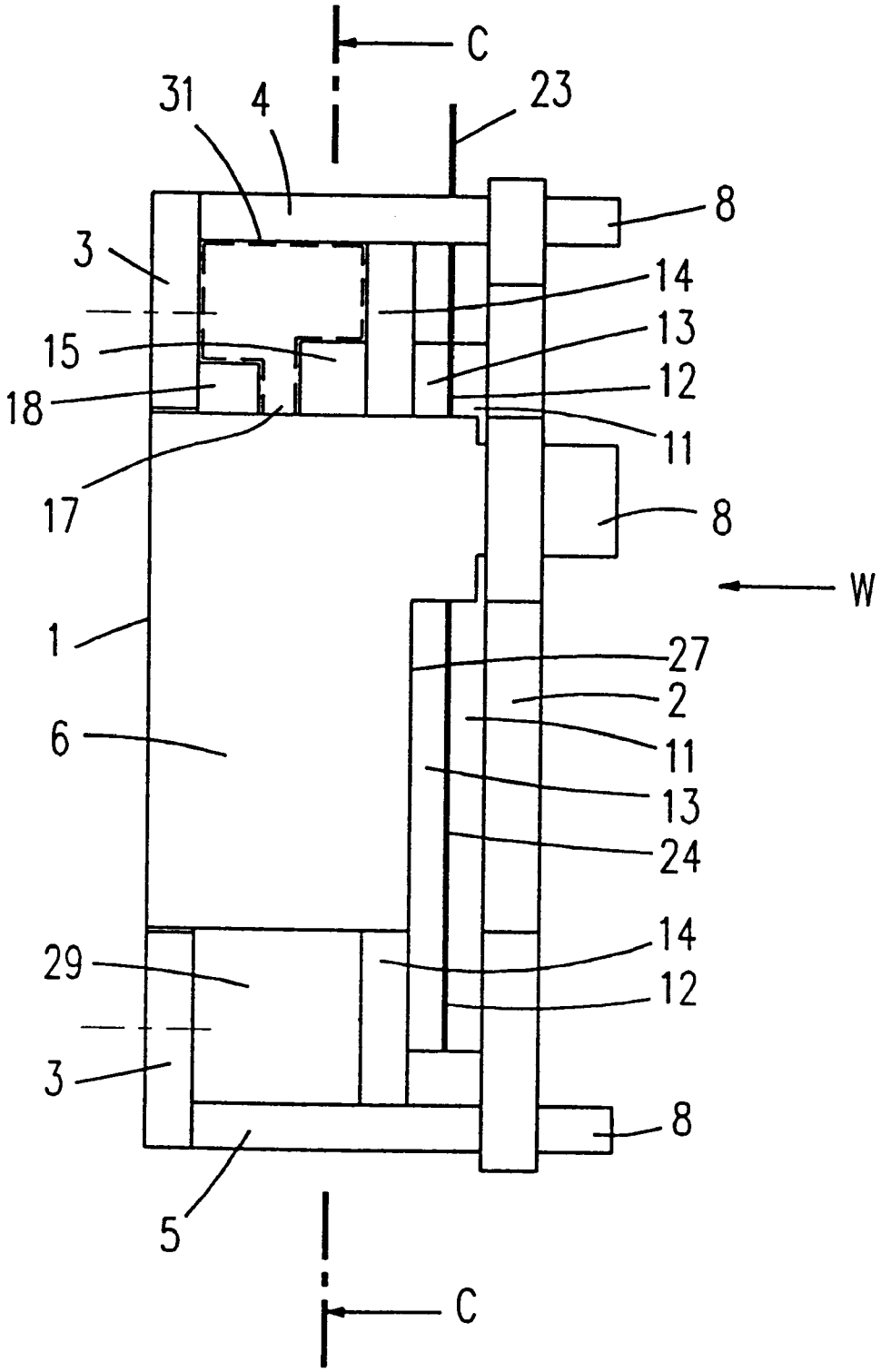
FIG. 4 is a side elevation of the first embodiment of the microwave component shown in FIG. 1, referred to as view Z hereinafter.

The two embodiments shown in the Figures represent a microwave component which forms a microwave circulator which may be designed to fulfil the function of a microwave isolator through a reflection-free closure of one of its three gates of its microwave guiding arrangement by means of a suitably dimensioned load impedance. This microwave component comprises a housing consisting of a substantially tub-shaped housing part 1 and a lid part 2. The substantially tub-shaped housing part 1 comprises a bottom portion 3 of at least substantially square circumference and four wall portions 4, 5, 6, 7 which follow the circumference of the bottom portion 3. A first wall portions 4 forms the wall of the housing part 1 which is visible in FIG. 3 (view Y). A second wall portions 5 forms the part of the housing portion 1 which is visible in FIG. 2 (view X), a third wall portion 6 forms the portion of the housing part 1 which is visible in FIG. 4 (view Z), and the fourth wall portion 7 forms the portion of the housing part 1 which is visible in a side elevation from the right, opposed to the view Z. The housing part 1 with the bottom portion 3 and wall portions 4 to 7 is preferably made as an integral whole from a substantially planar, magnetically permeable material by a process without metal removal, for example is stamped and folded from a magnetically permeable metal plate. The lid part 2 is also manufactured in a similar manner.

The wall portions 4 to 7 are shaped substantially rectangularly. At their edges facing away from the circumference of the bottom portion, they have stud-type projections 8 which will enter corresponding, mating cavities 9 in the lid part 2 when the housing part 1 and the lid part 2 are joined together. The housing part 1 and the lid part 2 may be joined to one another by gluing, welding, soldering, or flanging or bending of the stud-type projections 8. Any other connection method of the housing part 1 to the lid part 2 which leads to a similar result is also possible.

The wall portions 4 to 7 do not continue to the corners of the substantially square circumference of the bottom portion, but have voids in the regions of these corners. In these comers, bores 10 are provided in the bottom portion 3 which serve as screw holes for fastening the microwave component in an appliance or the like in which the microwave component is utilized. These bores have circular circumferences; alternatively, they may also be formed as slots.

The housing 1, 2 in the construction described above forms part of a magnetic circuit in which furthermore a number of substantially disc-shaped flat components is included which are arranged in a stack between the bottom portion 3 and the lid part 2. In order of stacking, these are, starting with the component adjoining the lid part 2: a first ferrite disc 11, a planar inner conductor 12, a second ferrite disc 13, an intermediate element 14, a circular permanent magnet 15, a thermoflux disc 16, and a strip 18 mounted with sliding possibility, separated by an air gap 17 in the arrangement shown. In this stack, the ferrite discs 11, 13 (ferromagnetic material) together with the inner conductor 12 form the microwave guiding arrangement, for which the lid part 2 and the intermediate element 14 form the symmetrically spaced outer conductors in this example. The intermediate element 14 is made electrically conducting for this purpose. The intermediate element 14 is furthermore formed from a magnetically permeable material and thus at the same time forms a pole disc for distributing and homogenizing the magnetic field which is generated by the permanent magnet 15 and which permeates the microwave guiding arrangement 11, 12, 13 perpendicularly to the planar dimension of the inner conductor 12. The intermediate element 14 is inserted with matching shape between the wall portions 4 to 7. To avoid a magnetic short-circuit with these wall portions 4 to 7, however, the intermediate element 14 is provided with recessed portions along its sides adjoining the wall portions 4 to 7, so that the intermediate element 14 bears on the wall portions with narrow bridges 19 only. Furthermore, the intermediate element 14 is preferably also manufactured from a magnetically permeable metal plate by a method without metal removal.

Instead of the intermediate element 14 described, a multiple intermediate element may be used, comprising an electrically conducting, foil-type part as the outer conductor for the microwave guiding arrangement 11, 12, 13 and an arrangement of magnetically permeable pole discs in a modification of the embodiment shown.

The strip 18 in the embodiment shown comprises a flat, magnetically permeable metal plate and lies flat against the bottom portion 3. The strip 18 together with the air gap 17 forms a magnetic tuning element which is geometrically changeable and which is present in the magnetic circuit. Shifting of the strip 18 in a direction parallel to the line A—A over the bottom portion 3 changes the contour, in particular the width, of the air gap 17, and thus changes the magnetic permeance thereof. This changes the magnetic field strength in the entire magnetic circuit, and thus also in the region of the microwave guiding arrangement. A simple and accurate tuning of the microwave component is rendered possible in this manner.

In the region of the bottom portion 3 where the strip is arranged with sliding possibility, an elongate opening 20 is provided in the bottom portion 3, for example a stamped-out portion, which can be partly covered by the strip 18 and which extends substantially in the sliding direction of the strip 18. The tuning properties of the magnetic tuning element can be influenced by the choice of contour of this opening 20.

Openings 21 and 22, through which a displacement of the strip 18, and thus a tuning operation can still be easily carried out also, for example, when the microwave component is mounted in an appliance, are provided in the first and the second wall portion 4, 5, respectively, along the edges where these respective wall portions 4, 5 lie against the circumference of the bottom portion 3. A separate mechanical fastening of the strip 18 to the bottom portion 3 is not shown and may indeed be absent, because the two elements are retained in their mutual positions by magnetic attraction. In addition, however, this position of the strip 18 may also be ensured by means of a glue, a locking paint, or the like.

The inner conductor 12 has three connection conductors 23, 24, 25 for forming the three gates of the microwave component. These are passed to the exterior from the housing 1, 2 of the microwave component through suitably arranged recesses 26, 27, 28 in the first, third, and fourth wall portions 4, 6, 7, respectively, such that an electrical insulation of the inner conductor 12 with respect to the housing 1, 2 is safeguarded.

Figure 5:
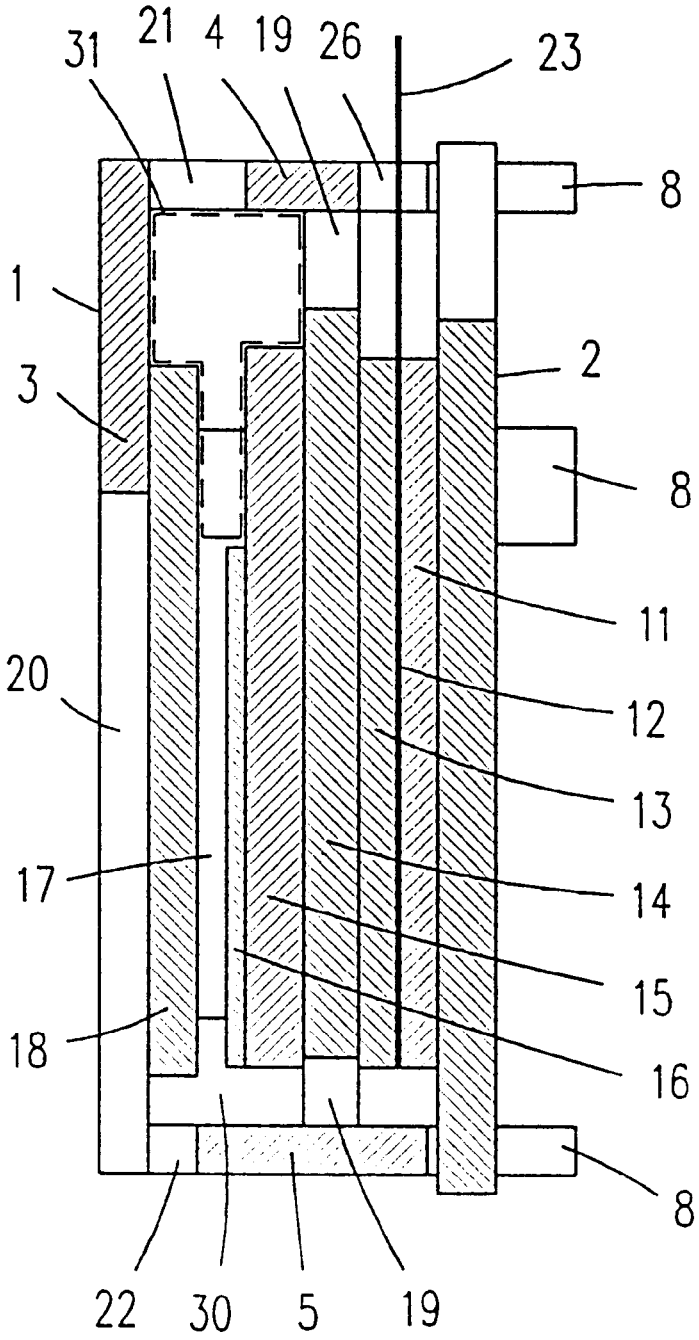
FIG. 5 is a cross-section through the first embodiment of the microwave component of FIG. 1 taken on the line A—A in FIG. 1.
Figure 8:
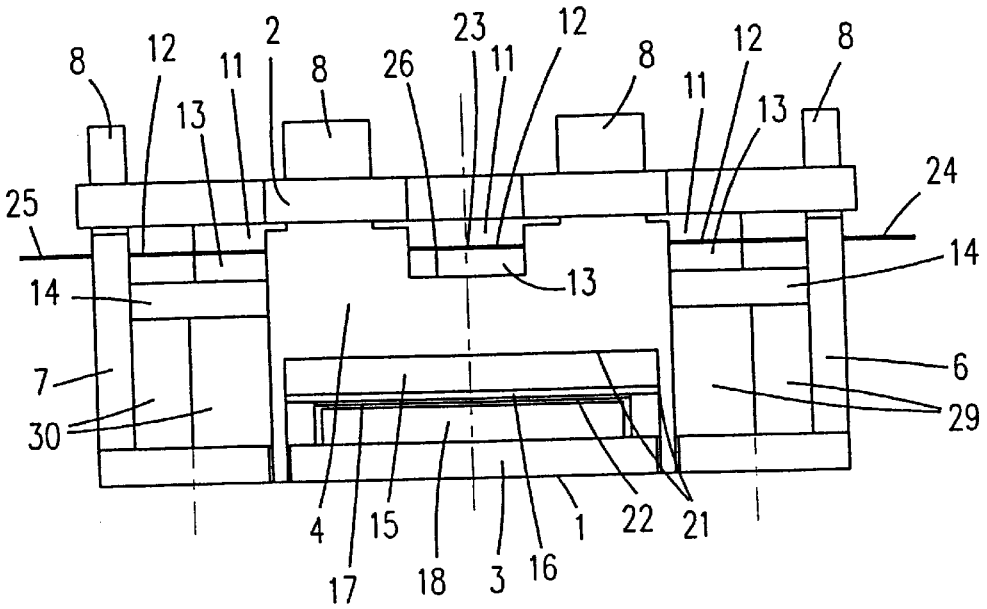
FIG. 8 is a front elevation (view Y) of a second embodiment of the microwave component of FIG. 1.
Figure 6:
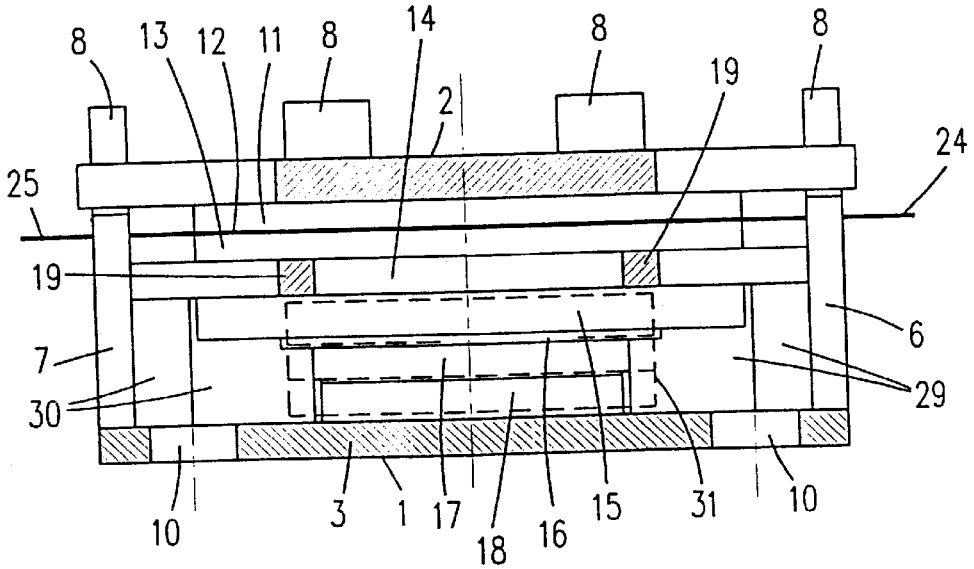
FIG. 6 is a cross-section through the first embodiment of the microwave component of FIG. 1 taken on the line B—B in FIG. 1.
Figure 7:
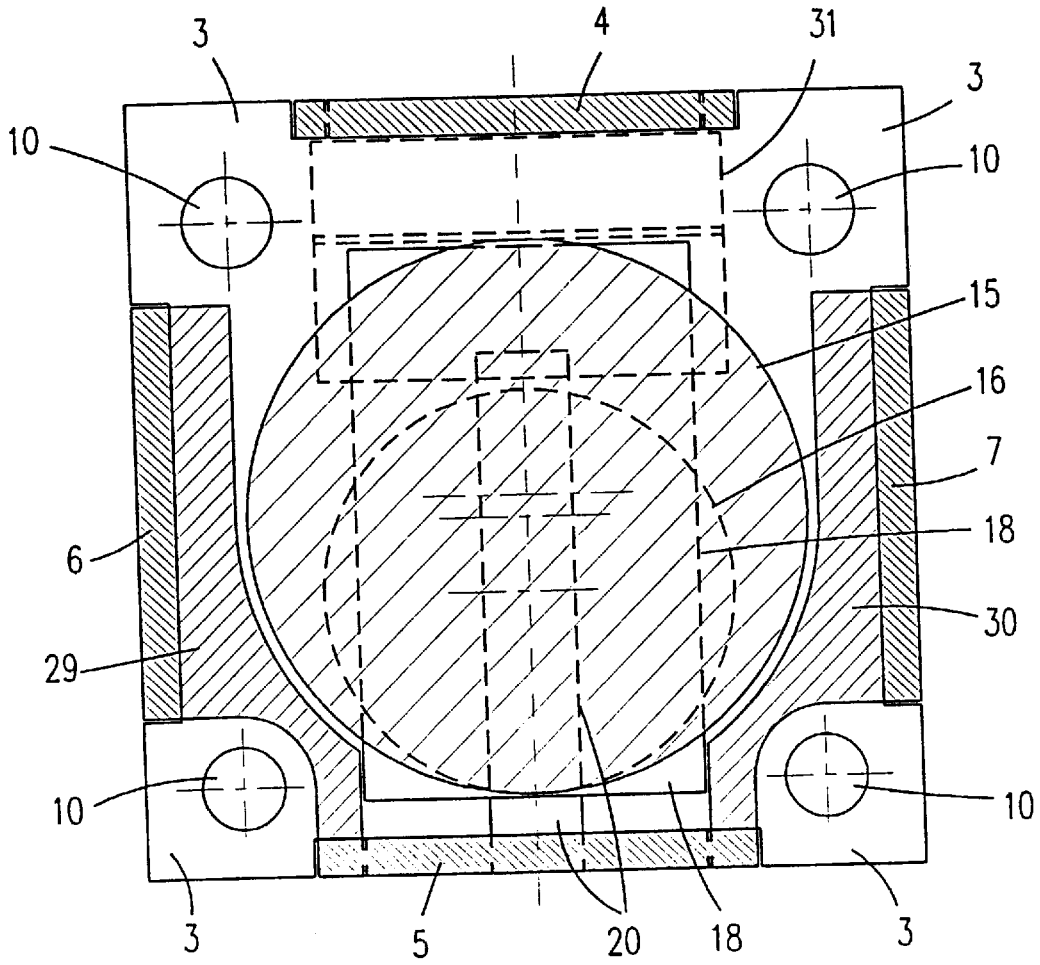
FIG. 7 is a cross-section through the first embodiment of the microwave component of FIG. 1 taken on the line C—C in FIG. 4.
Figure 9:
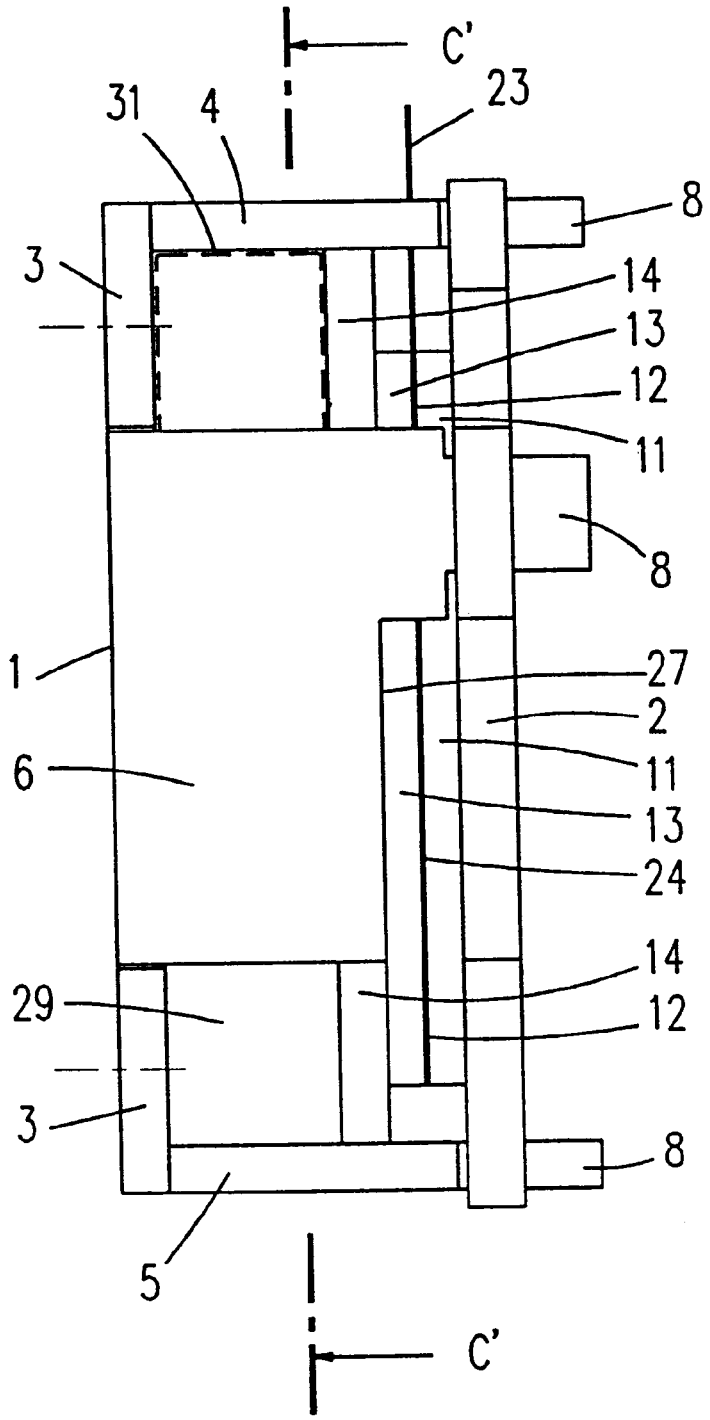
FIG. 9 is a side elevation (view Z) of the second embodiment of the microwave component of FIG. 1.

The fixation of the assembly position of the substantially disc-shaped components 11 to 18, wherein the air gap 17 results from the previously chosen assembly positions of the elements 11 to 16 and 18, is provided by two support elements 29, 30 which extend along the third and fourth wall portions 6 and 7, respectively, with matching shapes (and indeed with positive retention) between the bottom portion 3 and the intermediate element 14. These support elements 29, 30 are electrically conducting, but magnetically non-permeable, and are preferably made from aluminum. They define the spatial position of the intermediate element 14 with respect to the bottom portion 3, i.e. they define the interspacinig of these two elements. In addition, they represent the essential electrical connection between the housing part 1 and the intermediate element 14. The support elements 29, 30 here fill up part of the spatial region inside the microwave component which is bounded by the bottom portion 3, the intermediate element 14, and the wall portions 4 to 7. This spatial region further contains the permanent magnet 15 and the thermoflux disc 16, as well as the magnetic tuning element with the strip 18 and the air gap 17 which can be influenced thereby. A partial space 31 adjoining a sub-portion of the bottom portion 3 is left open by the components listed above inside the spatial region described. This partial space 31 is indicated with a bold broken line in FIGS. 4 and 5. In this partial space 31, which is immediately adjacent the bottom portion 3 and thus has a good electrical and especially thermal contact with the bottom portion 3, it is preferable to position the load impedance mentioned above by means of which one of the connection conductors of the inner conductor 12, preferably the first connection conductor 23, can be connected free from reflection. The partial space 31 present here renders possible a load impedance arrangement which can be designed for high power losses in relation to the dimensions of the housing 1, 2 of the microwave component. A microwave isolator of a high power class and having very compact dimensions can thus be constructed. A load impedance with a power dissipation in the range of between 50 and 200 W is envisaged in particular. This large load impedance can be accommodated inside the housing 1, 2 without an increase in the dimensions of the bottom portion 3. The arrangement of the load impedance adjacent the bottom portion 3 further safeguards a thermal uncoupling from the microwave guiding arrangement 11 to 13.

The strip 18 is first inserted into the housing part 1 during assembly. Then the support elements 29, 30 are inserted into the housing part 1. The thermoflux disc 16 and the permanent magnet 15 are then positioned in the spatial region lying between the support elements 29, 30 and the bottom portion 3 or the strip 18, and this spatial region is covered with the intermediate element 14. To ensure the air gap 17 being present, the height of the support elements 29, 30 in the viewing direction of view W must be greater than the sum of the heights of the strip 18, the thermoflux disc 16, and the permanent magnet 15. Instead of the single thermoflux disc 16 shown for reasons of simplicity, an arrangement of several thermoflux discs may be used in practice. It is advantageous to fasten the permanent magnet 15 and the thermoflux disc 16 on the intermediate element 14 in a pre-assembly step, for example by gluing, and to place the subassembly 14, 15, 16 thus prepared with the permanent magnet 15 forward onto the support elements 29, 30, i.e. in the direction of the bottom portion 3. The microwave guiding arrangement with the ferrite discs 11, 13 and the inner conductor 12 is placed layer by layer on the intermediate element 14, and is fastened in that the lid part 2 is provided and fixed to the housing part 1.

The assembly of the entire microwave component can be carried out stackwise in a mounting jig which, for example, comprises three pins which are threaded through corresponding holes in the bottom portion 3, which are not shown in the embodiments, for assembly purposes and which define the positions of the individual, disc-shaped components 11 to 16 and 18. After the lid part 2 has been fastened, the microwave element is taken off the pins.

The permanent magnet 15 is incorporated in the fully magnetized state. The magnetic field necessary for the operation of the microwave component is tuned by means of the movable strip. The opening 20 in the bottom portion 3 may be used for mechanical access to this strip 18 as long as this opening is accessible, in dependence on the assembly position of the microwave component.

Figure 10:
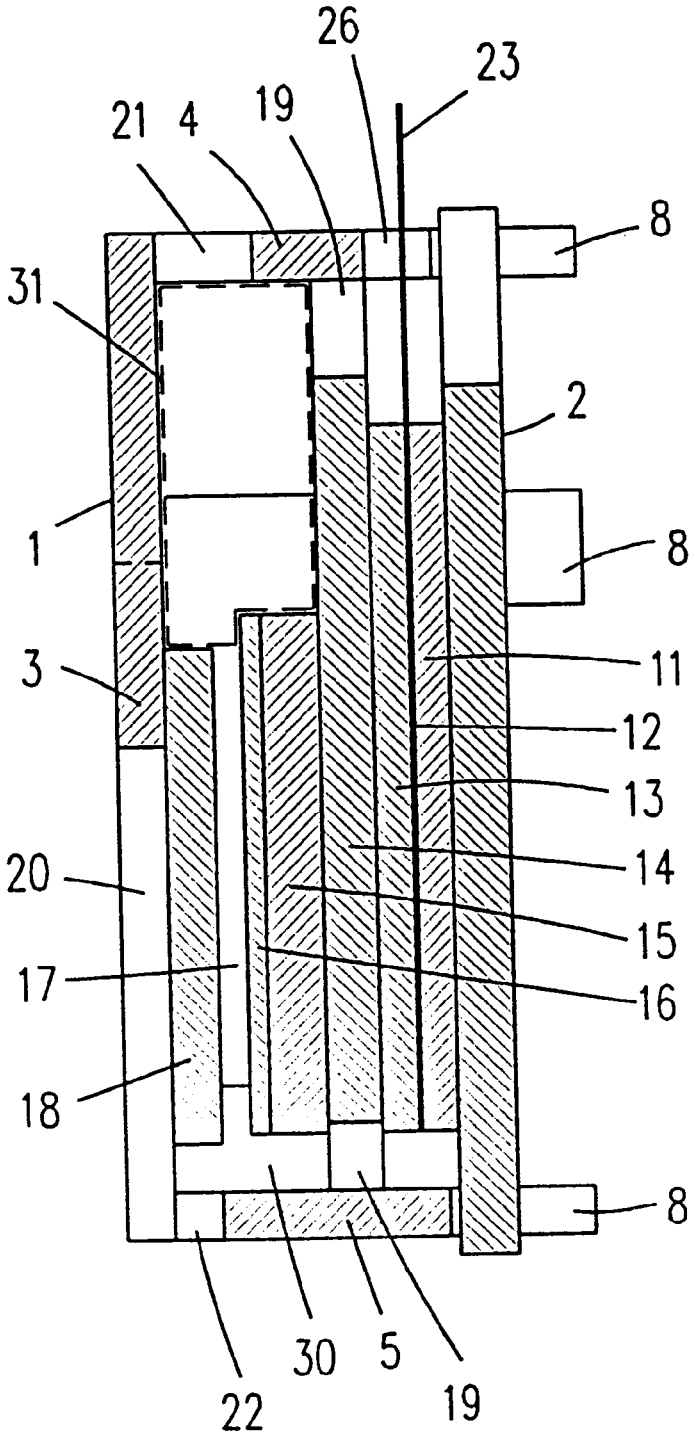
FIG. 10 is a cross-section through the second embodiment of the microwave component of FIG. 1 taken on the line A—A in FIG. 1.
Figure 11:
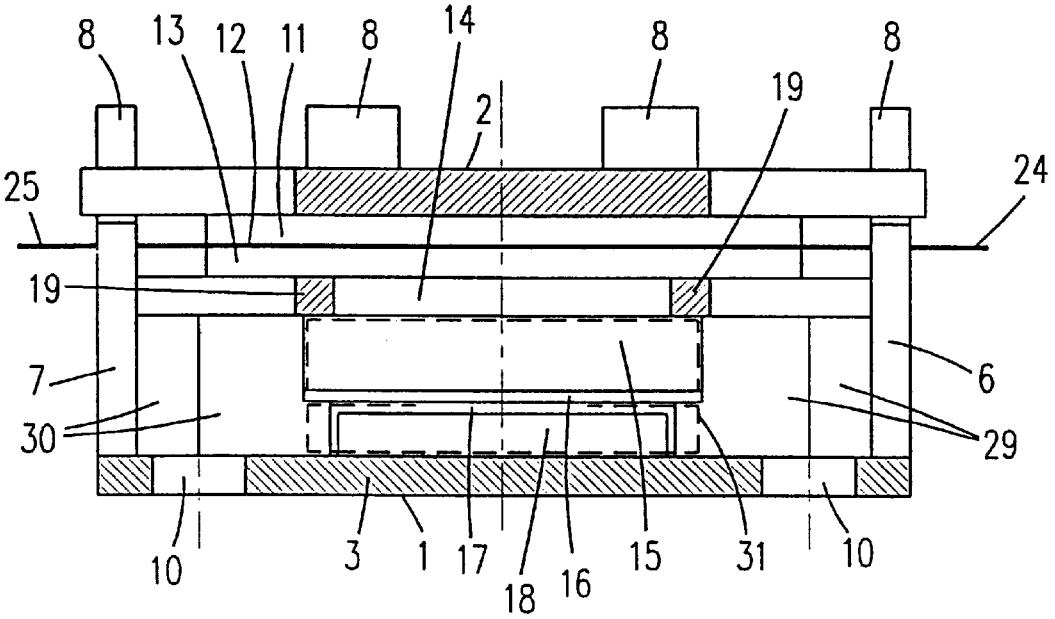
FIG. 11 is a cross-section through the second embodiment of the microwave component of FIG. 1 taken on the line B—B in FIG. 1.
Figure 12:
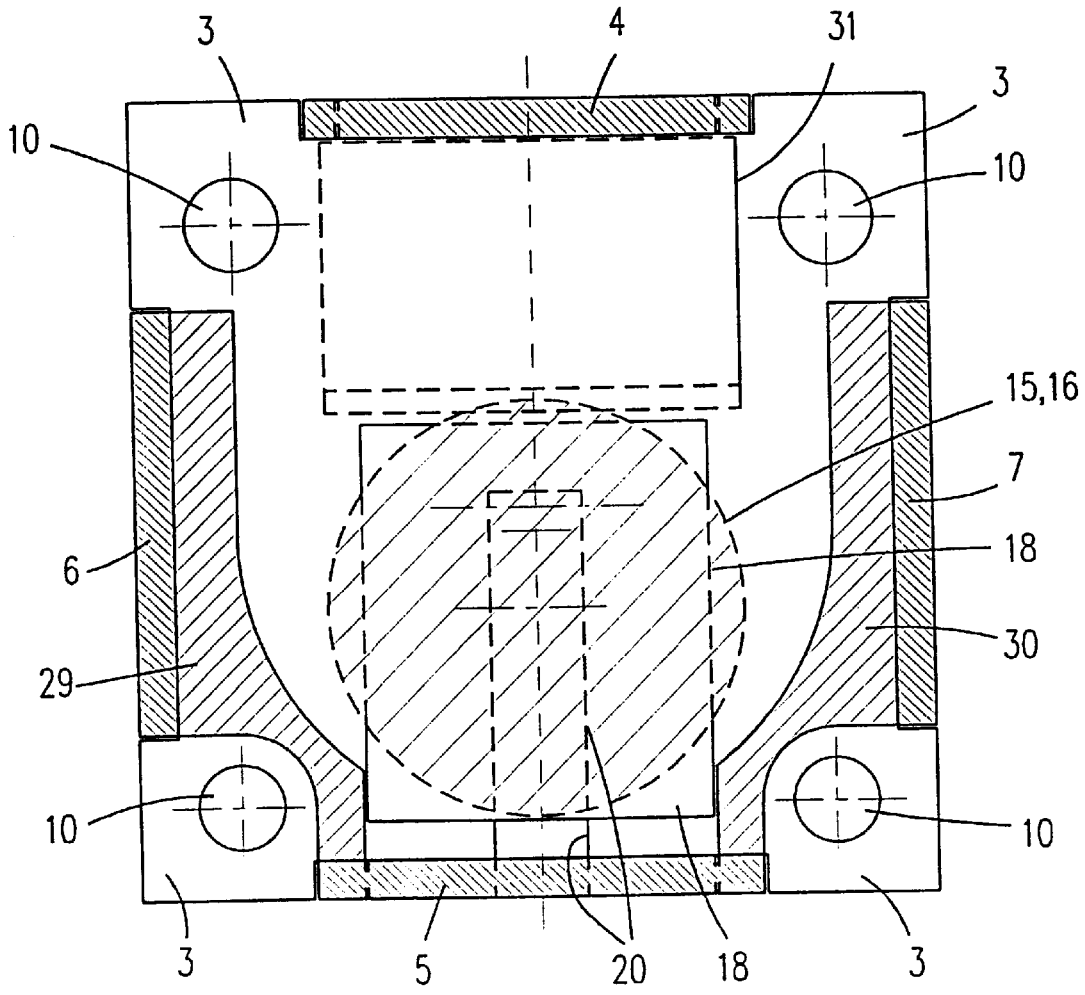
FIG. 12 is a cross-section through the second embodiment of the microwave component of FIG. 1 taken on the line C'—C' in FIG. 9.

The embodiments shown in the Figures differ from one another as regards, the shape of the partial space 31 as a result of the shape chosen for the permanent magnet 15 each time. Whereas in the first embodiment of FIGS. 1 to 7 the disc-shaped permanent magnet has a radial dimension which corresponds substantially to that of the ferrite discs 11, 13, the second embodiment of FIGS. 1, 2, and 8 to 12 shows a permanent magnet of smaller radial dimensions. To achieve a comparable volume for the permanent magnet 15, the thickness of the disc-shaped permanent magnet 15 in the second embodiment (FIG. 10) is chosen to be greater than in the first embodiment. Similarly, the partial space 31 in the first embodiment extends for a major portion in the intermediate space between the permanent magnet 15 and the strip 18, i.e. in the air gap 17. By contrast, the partial space 31 in the second embodiment lies to a much greater extent in a spatial region between the bottom portion 3 and the intermediate element 14, bounded laterally by the first wall portion 4 at one side and by the permanent magnet 15 and the strip 18 at the other side (FIG. 10). The smaller radial dimension of the permanent magnet 15 in the second embodiment in addition renders possible an increase in the partial space 31 for the accommodation of a load impedance, as compared with the first embodiment.

What is claimed is:

1. A microwave component with a microwave guiding arrangement for conducting electromagnetic waves and a magnetic circuit comprising a ferromagnetic material which is arranged in operational connection with the electromagnetic waves and is capable of being energized by means of a magnetic field of a given field strength, a permanent magnet for generating the magnetic field, and a geometrically changeable magnetic tuning element having a changeable magnetic permeance for the purpose of adjusting the magnetic field strength, wherein the magnetic tuning element comprises a magnetically permeable strip which is slidable in a spatial region which forms part of the magnetic circuit and whose magnetic permeance is smaller than that of the strip, wherein the geometric shape of the spatial region is changed by a sliding movement of the strip.

2. A microwave component as claimed in claim 1, characterized by a housing which surrounds at least partly the microwave guiding arrangement, the ferromagnetic material, and the magnet, which is formed at least locally from a magnetically permeable material and is arranged in the magnetic circuit, which forms at least part of the magnetic tuning element with at least one of its regions arranged in the magnetic circuit, and to which the strip is mounted for sliding.

3. A microwave component as claimed in claim 2, characterized in that the housing comprises a substantially tub-shaped housing part having a bottom portion which covers the surface region of the housing, which forms at least part of the magnetic tuning element, and on which the strip is arranged for sliding.

4. A microwave component as claimed in claim 1, characterized in that an air gap of changeable width is formed by the strip.

5. A microwave component as claimed in claim 2, characterized in that the region in which the strip is arranged for sliding comprises an elongate opening which can be covered at least partly by the strip and which extends substantially in the sliding direction of the strip.

* * * * *